United States Patent [19]

Harkleroad et al.

[11] Patent Number: 4,993,920

[45] Date of Patent: Feb. 19, 1991

[54] AIR MATTRESS PUMPING AND VENTING SYSTEM

[76] Inventors: Barry A. Harkleroad, 6478 W. U.S. 52, New Palestine, Ind. 46163; Eric D. Blom, 8939 Shagbark Rd., Indianapolis, Ind. 46260

[21] Appl. No.: 334,462

[22] Filed: Apr. 7, 1989

[51] Int. Cl.[5] ..... F04B 49/08

[52] U.S. Cl. ..... 417/44; 417/63; 5/453

[58] Field of Search ..... 417/26, 44, 63; 5/453, 5/455

[56] References Cited

U.S. PATENT DOCUMENTS

| | | | |
|---|---|---|---|
| 1,659,290 | 2/1928 | Gille | 417/44 |
| 4,614,479 | 9/1986 | Liu | 417/44 |
| 4,651,838 | 3/1987 | Hamilton et al. | 417/44 |
| 4,711,275 | 12/1987 | Ford et al. | 5/453 |
| 4,825,486 | 5/1989 | Kimura et al. | 5/453 |
| 4,829,616 | 5/1989 | Walker | 5/453 |
| 4,840,425 | 6/1989 | Noble | 5/453 |

OTHER PUBLICATIONS

"Waffle Mattress Overview", Indiana Brace Co., Inc., 1815 North Capitol, Suite G01, Indianapolis, Indiana 46202-1273.

"CLINTRON® Air Fluidized Therapy—Therapy Without Compromise", Support Systems International, Inc., 4349 Corproate Road, Charleston, South Carolina 29405, Nov. 1987.

KinAir$_x$/TC TM Instruction Manual, Kinetic Concepts, P.O. Box 8588, San Antonio, Texas, 78208, Jul. 1986.

Lancaster, Shelley, R.N., M.S.N., Thomas Southern, M.D. and Sandy Janitz, R.N., "The Management and Prevention of Pressure Ulcers at Methodist Hospital of Indiana, Inc.", Nov. 1988.

Krouskop, Thomas A., P.E., Ph.D., Director, The Rehabilitation Engineering Program, Baylor College of Medicine and The Institute of Rehabilitation and Research, "Interface Pressure at Bony Prominences While Lying on the KinAir Beta Air Support System".

"The Clini-Care Program. Giving You the Economic Edge in the Treatment of Pressure Ulcers", Clinicare Systems, Inc., 10 Centre Drive, Orchard Park, New York 14127.

*Primary Examiner*—Michael Koczo
*Assistant Examiner*—David W. Scheuermann
*Attorney, Agent, or Firm*—Barnes & Thornburg

[57] ABSTRACT

In combination with an air mattress, the pressure within which is to be controlled, a first switch for actuation at a first air pressure and a second switch for actuation at a second air pressure higher than the first. The difference between the first and second air pressures defines a zone within which the air pressure in the mattress is not controlled. The first and second switches have air inlets. A source of compressed air has an outlet. An electrically actuated air valve has an air inlet and an air outlet. The first and second switches are coupled across a source of electrical power for controlling the supply of compressed air from the compressed air source to the mattress and exhausting compressed air from the mattress, respectively.

25 Claims, 3 Drawing Sheets

AIR MATTRESS PUMPING AND VENTING SYSTEM

This invention relates to fluid pumping and fluid pressure maintenance systems. It is disclosed in the context of apparatus for inflating, and for maintaining the inflated pressure of, a mattress for minimizing the likelihood of decubitus, bedsores, in bedridden patients. However, it is believed to be useful in other applications as well.

There are commercially available mattresses which are used in hospital and other healthcare settings for reducing the likelihood that patients bedridden for extended periods of time will develop bedsores. One such mattress is the waffle mattress marketed by Indiana Brace Co., Inc., 1815 North Capitol, Suite G01, Indianapolis, Ind. 46202. This mattress is designed to be inflated to a pressure in the range of 11.9 mm Hg to 22.8 mm Hg, depending upon the weight of the patient who is to occupy it. Its design is intended to reduce the likelihood of the patient developing decubitus ulcers with the mattress inflated to within this range. It is an object of the present invention to provide a mechanism for inflating, and for maintaining the inflation of, the waffle mattress within this effective inflation range.

According to the invention, an apparatus is provided for pressurizing a load, the pressure of which is to be controlled, with a fluid such as air. The apparatus includes a first electrical switch for actuation at a first fluid pressure, the first switch having a control fluid pressure inlet, and a second electrical switch for actuation at a second fluid pressure higher than the first, the second switch having a control fluid pressure inlet. The apparatus further includes an electrically actuated fluid valve having a fluid inlet and a fluid outlet, and a source of fluid pressure, such as a fluid pump or external fluid source, having a fluid outlet. Means are provided for coupling the first switch to the source of fluid pressure for controlling it so that when the first switch is closed, the source provides fluid under pressure at its outlet. Additional means are provided for coupling the second switch to the fluid valve for controlling it so that when the second switch is closed, the valve is open to permit fluid flow between the valve's inlet and outlet. Additional means are provided for coupling the outlet of the source of fluid pressure in a fluid circuit including the inlets of the first and second switches and the fluid valve and the load.

Illustratively, according to certain embodiments of the invention, the means for coupling the outlet of the fluid pressure source in the fluid circuit comprises a check valve between the outlet of the fluid pressure source and the inlets of the first and second switches and fluid valve and the load. According to certain other embodiments of the invention, the means for coupling the outlet of the fluid pressure source in this fluid circuit comprises a fluid pressure regulator.

Further illustratively according to certain embodiments of the invention, the apparatus includes a steering valve having an inlet and two outlets, a timer, and means for coupling the steering valve to the timer to be controlled thereby to steer fluid pressure between the steering valve inlet and one or the other of the two steering valve outlets.

According to certain embodiments, the load comprises two reservoirs, such as two waffle mattresses which are alternately to be maintained under fluid pressure and vented to atmosphere. This might be the case, for example, where a bedridden patient is to be rolled from side to side by alternately inflating and deflating the two mattresses. The check valve or fluid pressure regulator in such a system is coupled between the outlet from the source of fluid pressure and the steering valve inlet. Means are provided for coupling one outlet of the steering valve to one of the reservoirs for the purpose of inflating it. Means are also provided for coupling the other outlet of the steering valve to the other reservoir for the purpose of inflating it.

The outlet of the fluid valve is vented to atmosphere in the illustrated embodiments in order to reduce the fluid pressure in the load when the fluid valve is open.

Illustratively the first switch is normally closed, the second switch is normally open, and the fluid valve is solenoid-operated.

The invention may best be understood by referring to the following description and accompanying drawings which illustrate the invention. In the drawings.

Figure 1:
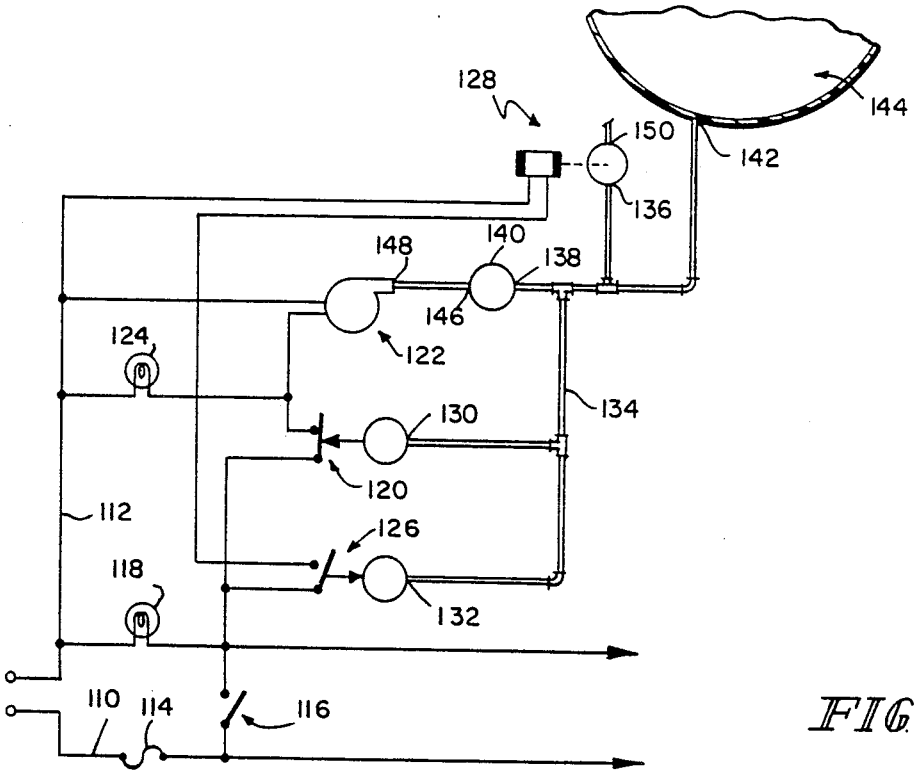
FIG. 1 illustrates a partly block and partly schematic diagram of an embodiment of the invention.

Referring now particularly to FIG. 1, a conductor 110 is provided for coupling to the hot side of a 115 VAC, 60 Hz line. A conductor 112 is provided for coupling to the neutral side of the 115 VAC, 60 Hz line. A fuse 114, a main power switch 116 and a main power indicator incandescent lamp 118 are coupled in series between conductors 110, 112. A first pressure actuated, normally closed electrical switch 120 and an air pump 122 in series are coupled across lamp 118. A "pump on" indicator incandescent lamp 124 is coupled in parallel with pump 122. A series combination of a second pressure actuated, normally open electrical switch 126 and a normally closed solenoid valve 128 are also coupled across lamp 118.

Switch 120 has a control fluid pressure inlet 130. Switch 126 has a control fluid pressure inlet 132. Inlets 130, 132 are coupled through a common sensing conduit 134 to a fluid inlet 136 of valve 128, to the low pressure outlet 138 of a check valve 140, and to the inlet 142 of the load 144, which illustratively is a waffle mattress. The high pressure inlet 146 of check valve 140 is coupled to the outlet 148 of pump 122. The outlet 150 of valve 128 is vented to atmosphere.

In operation, once switch 116 is closed, if the fluid pressure in conduit 134 is below the pressure at which switch 120 opens, switch 120 is closed, placing pump 122 across the line. Pump 122 runs, pressurizing the load 144. The pressure at which switch 120 opens is adjustable. That pressure will be less than the pressure at which switch 126 closes which will also typically be adjustable. This provides some "hysteresis" or "dead zone" in the control of the pressure to which load 144 is pressurized. In any event, once conduit 134 is pressurized to the pressure at which switch 120 opens, switch 120 opens and the pump 122 is turned off. If there is any subsequent decrease of sufficient magnitude in the pressure in load 144, such as by leakage of fluid from the load, switch 120 again closes and pump 122 begins to pressurize conduit 134 to the set pressure.

If the pressure in load 144 should rise above the set pressure of switch 126, such as by a patient shifting more of his or her weight onto the load 144, switch 126 closes, energizing solenoid valve 128 and venting fluid pressure from load 144 through inlet 136 to outlet 150 and thus to atmosphere.

Figure 2:
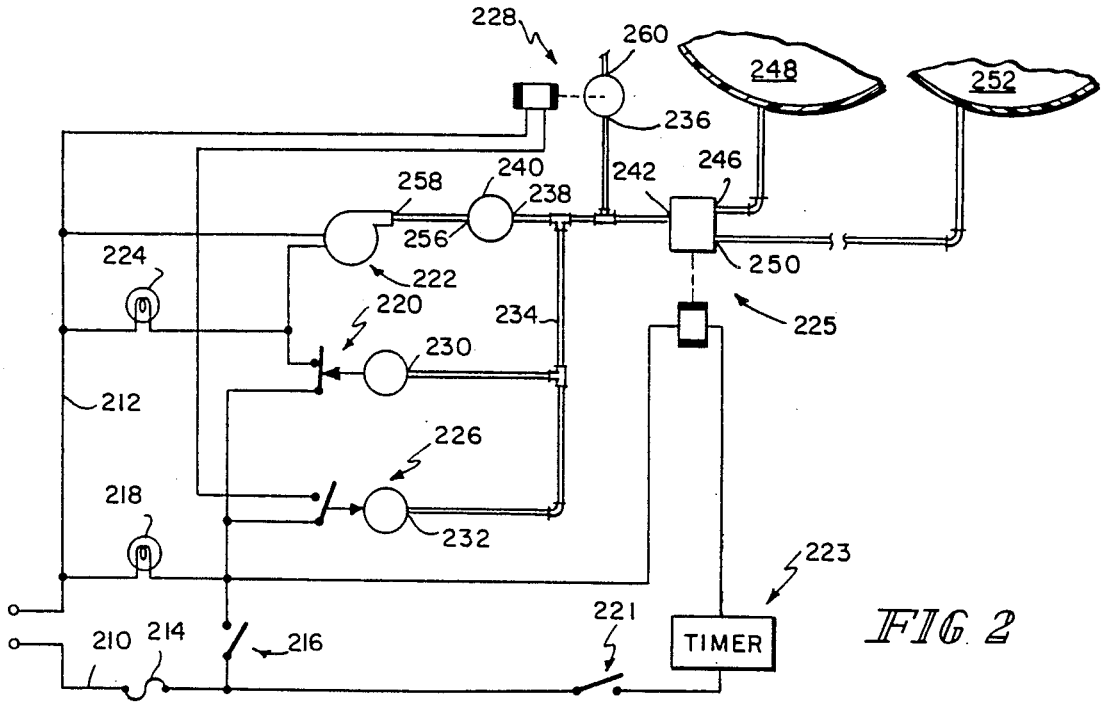
FIG. 2 illustrates a partly block and partly schematic diagram of another embodiment of the invention.

Referring now particularly to FIG. 2, a conductor 210 is provided for coupling to the hot side of a 115 VAC, 60 Hz line. A conductor 212 is provided for coupling to the neutral side of the 115 VAC, 60 Hz line. A fuse 214, a main power switch 216 and a main power indicator incandescent lamp 218 are coupled in series between conductors 210, 212. A first pressure actuated, normally closed electrical switch 220 and an air pump 222 in series are coupled across lamp 218. A "pump on" indicator incandescent lamp 224 is coupled in parallel with pump 222. A series combination of a second pressure actuated, normally open electrical switch 226 and a normally closed solenoid valve 228 are also coupled across lamp 218. A series combination of a timer on/off switch 221, a timer 223 and a four-way solenoid steering valve 225 is coupled across the main power switch 216.

Switch 220 has a control fluid pressure inlet 230. Switch 226 has a control fluid pressure inlet 232. Inlets 230, 232 are coupled through a common sensing conduit 234 to a fluid inlet 236 of valve 228, to the low pressure outlet 238 of a check valve 240, and to the inlet 242 of steering valve 225. One outlet 246 of valve 225 is coupled to a load 248, which illustratively is a first waffle mattress. The other outlet 250 of valve 225 is coupled to a load 252, which illustratively is a second waffle mattress. The high pressure inlet 256 of check valve 240 is coupled to the outlet 258 of pump 222. The outlet 260 of valve 228 is vented to atmosphere.

In operation, when switch 221 is closed and timer 223 places steering valve 225 in its position coupling its inlet 242 to its outlet 246, pressure is maintained in load 248 in the same manner as in the embodiment of FIG. 1. That is, once switch 216 is closed, if the fluid pressure in conduit 234 is below the pressure at which switch 220 opens, switch 220 is closed, placing pump 222 across the line. Pump 222 runs, pressurizing the load 248. The pressure at which switch 220 opens is adjustable. That pressure will be less than the pressure at which switch 226 closes which will also typically be adjustable. Once conduit 234 is pressurized to the pressure at which switch 220 opens, switch 220 opens and the pump 222 is turned off. If there is any subsequent decrease of sufficient magnitude in the pressure in load 248, switch 220 again closes and pump 222 begins to pressurize conduit 234 to the set pressure.

If the pressure in load 248 should rise above the set pressure of switch 226, switch 226 closes, energizing solenoid valve 228 and venting fluid pressure from load 248 through inlet 236 to outlet 260 and thus to atmosphere.

When switch 221 is closed and timer 223 places steering valve 225 in its position coupling its inlet 242 to its outlet 250, pressure is maintained in load 252 in the same manner as previously described with respect to load 248.

Figure 3:
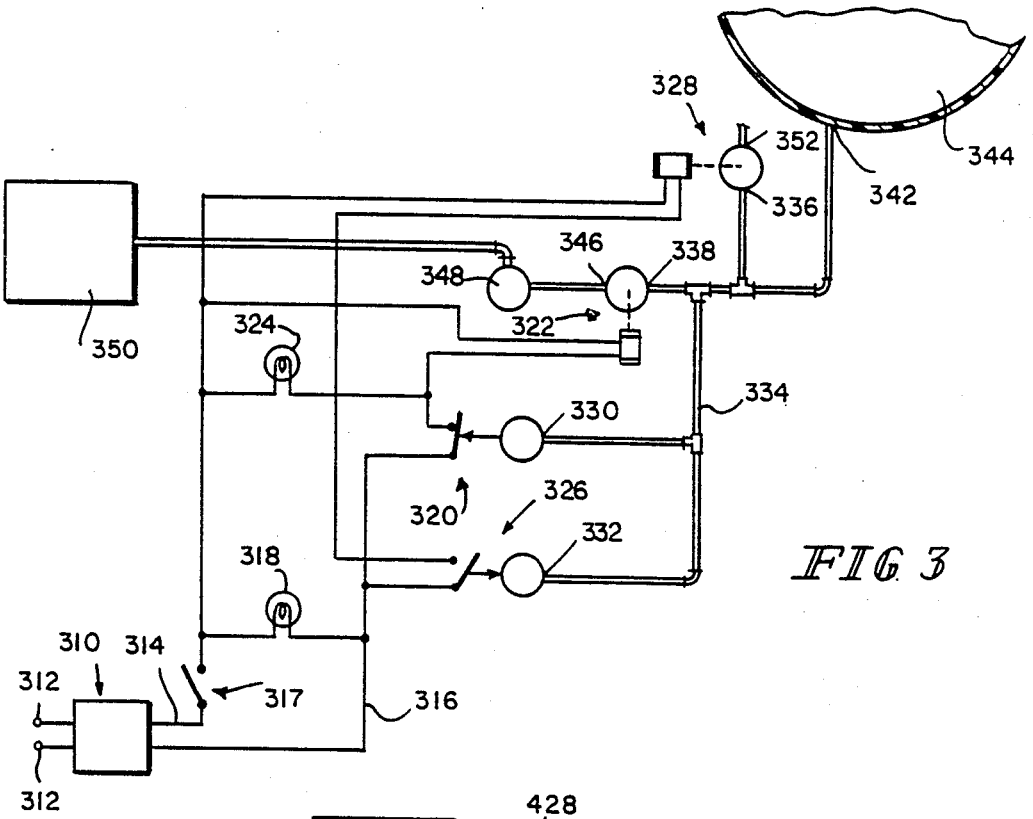
FIG. 3 illustrates a partly block and partly schematic diagram of another embodiment of the invention.

Referring now to FIG. 3, a 115 VAC-to-12 VDC converter 310 is coupled across a 115 VAC line 312. 12 VDC is maintained across conductors 314, 316 of converter 310. A main power switch 317 and a main power indicator incandescent lamp 318 are coupled in series between conductors 314, 316. A first pressure actuated, normally closed electrical switch 320 and an air valve 322 in series are coupled across lamp 318. An "airflow on" indicator incandescent lamp 324 is coupled in parallel with valve 322. A series combination of a second pressure actuated, normally open electrical switch 326 and a normally closed solenoid valve 328 are also coupled across lamp 318.

Switch 320 has a control fluid pressure inlet 330. Switch 326 has a control fluid pressure inlet 332. Inlets 330, 332 are coupled through a common sensing conduit 334 to a fluid inlet 336 of valve 328, to the outlet 338 of valve 322, and to the inlet 342 of the load 344, which illustratively is a waffle mattress. The inlet 346 of valve 322 is coupled through an air pressure regulator 348 to a source 350 of compressed air, illustratively 40–80 p.s.i.g. hospital air. The outlet 352 of valve 328 is vented to atmosphere.

In operation, once switch 317 is closed, if the fluid pressure in conduit 334 is below the pressure at which switch 320 opens, switch 320 is closed, placing valve 322 across conductors 314, 316. Valve 322 opens, pressurizing the load 344. The pressure at which switch 320 opens is adjustable. That pressure will be less than the pressure at which switch 326 closes which will also typically be adjustable. This provides some "hysteresis" or "dead zone" in the control of the pressure to which load 344 is pressurized. In any event, once conduit 334 is pressurized to the pressure at which switch 320 opens, switch 320 opens and valve 322 is closed. If there is any subsequent decrease of sufficient magnitude in the pressure in load 344, such as by leakage of fluid from the load, switch 320 again closes and valve 322 pressurizes conduit 334 to the set pressure.

If the pressure in load 344 should rise above the set pressure of switch 326, such as by a patient shifting more of his or her weight onto the load 344, switch 326 closes, energizing solenoid valve 328 and venting fluid pressure from load 344 through inlet 336 to outlet 352 and thus to atmosphere.

Figure 4:
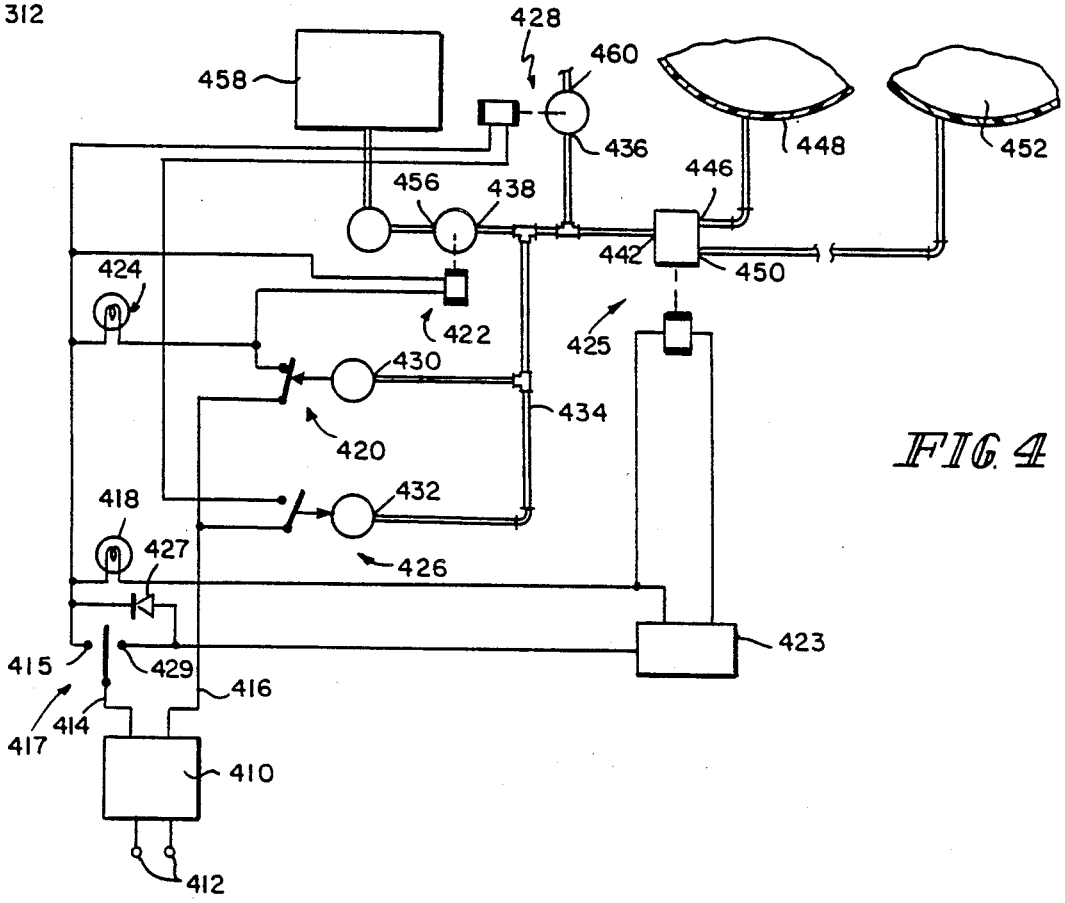
FIG. 4 illustrates a partly block and partly schematic diagram of another embodiment of the invention.

Referring now particularly to FIG. 4, a 115 VAC-to-12 VDC converter 410 is coupled across a 115 VAC line 412. 12 VDC is maintained across conductors 414, 416 of converter 410. One stationary contact 415 of a single pole-double throw main power switch 417 and a main power indicator incandescent lamp 418 are coupled in series between conductors 414, 416. A first pressure actuated, normally closed electrical switch 420 and an air valve 422 in series are coupled across lamp 418. An "airflow on" indicator incandescent lamp 424 is coupled in parallel with valve 422. A series combination of a second pressure actuated, normally open electrical switch 426 and a normally closed solenoid valve 428 are also coupled across lamp 418. A series combination of the other stationary contact 429 of switch 417, a timer 423 and a four-way solenoid valve 425 is coupled to conductor 416. The anode of a diode 427 is coupled to stationary contact 429. The cathode of diode 427 is coupled to stationary contact 415.

Switch 420 has a control fluid pressure inlet 430. Switch 426 has a control fluid pressure inlet 432. Inlets 430, 432 are coupled through a common sensing conduit 434 to a fluid inlet 436 of valve 428, to the outlet 438 of valve 422, and to the inlet 442 of valve 425. One outlet 446 of valve 425 is coupled to a load 448, which illustratively is a first waffle mattress. The other outlet 450 of valve 425 is coupled to a load 452, which illustratively is a second waffle mattress. The inlet 456 of valve 422 is coupled to a source 458 of compressed air. The outlet 460 of valve 428 is vented to atmosphere.

In operation, when switch 417 couples conductor 414 to stationary contact 429 and timer 423 places valve 425 in its position coupling its inlet 442 to its outlet 446, pressure is maintained in load 448 in the same manner as in the embodiment of FIG. 3. That is, once switch 417 is placed in this position, if the fluid pressure in conduit 434 is below the pressure at which switch 420 opens, switch 420 is closed, placing valve 422 across the line. Valve 422 opens, pressurizing the load 448. The pressure at which switch 420 opens is adjustable. That pressure will be less than the pressure at which switch 426 closes which will also typically be adjustable. Once conduit 434 is pressurized to the pressure at which switch 420 opens, switch 420 opens and the valve 422 closes. If there is any subsequent decrease of sufficient magnitude in the pressure in load 448, switch 420 again closes and valve 422 opens to pressurize conduit 434 to the set pressure.

If the pressure in load 448 should rise above the set pressure of switch 426, switch 426 closes, energizing solenoid valve 428 and venting fluid pressure from load 448 through inlet 436 to outlet 460 and thus to atmosphere.

When switch 417 couples conductor 414 to stationary contact 429 and timer 423 places valve 425 in its position coupling its inlet 442 to its outlet 450, pressure is maintained in load 452 in the same manner as previously described with respect to load 448.

When switch 417 couples conductor 414 to stationary contact 415, the timer 423 and valve 425 are removed from the circuit by the now reverse-biased diode 427, and the system functions as described in connection with FIG. 3.

Figure 5:
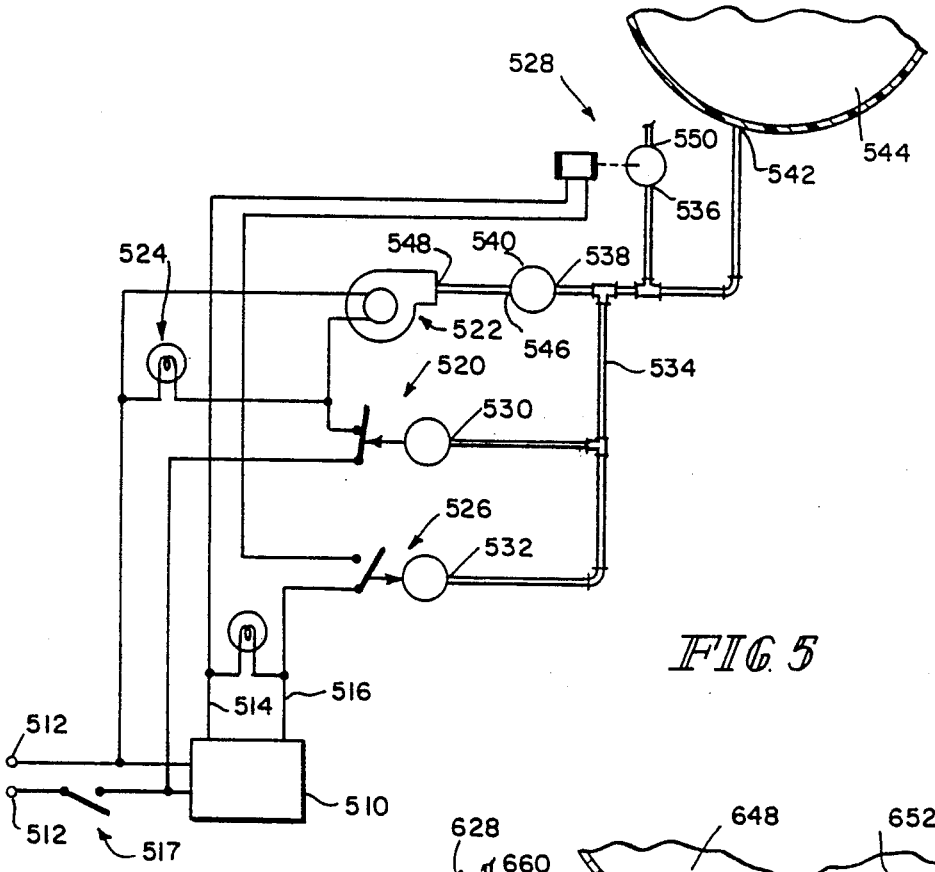
FIG. 5 illustrates a partly block and partly schematic diagram of another embodiment of the invention; and, FIG. 6 illustrates a partly block and partly schematic diagram of another embodiment of the invention.

Referring now to FIG. 5, a 115 VAC-to-12 VDC converter 510 and a main power switch 517 are coupled in series across a 115 VAC line 512. 12 VDC is maintained across conductors 514, 516 of converter 510. A main power indicator incandescent lamp 518 is coupled across conductors 514, 516. A first pressure actuated, normally closed electrical switch 520 and an air pump 522 in series are coupled across the 115 VAC line 512 on the converter 510 side of switch 517. A "pump on" indicator incandescent lamp 524 is coupled in parallel with pump 522. A series combination of a second pressure actuated, normally open electrical switch 526 and a normally closed solenoid valve 528 is also coupled across lamp 518.

Switch 520 has a control fluid pressure inlet 530. Switch 526 has a control fluid pressure inlet 532. Inlets 530, 532 are coupled through a common sensing conduit 534 to a fluid inlet 536 of valve 528, to the low pressure outlet 538 of a check valve 540, and to the inlet 542 of the load 544, which illustratively is a waffle mattress. The high pressure inlet 546 of check valve 540 is coupled to the outlet 548 of pump 522. The outlet 550 of valve 528 is vented to atmosphere.

In operation, once switch 517 is closed, if the fluid pressure in conduit 534 is below the pressure at which switch 520 opens, switch 520 is closed, placing pump 522 across the line. Pump 522 runs, pressurizing the load 544. The pressure at which switch 520 opens is adjustable. That pressure will be less than the pressure at which switch 526 closes which will also typically be adjustable. This provides some "hysteresis" or "dead zone" in the control of the pressure to which load 544 is pressurized. In any event, once conduit 534 is pressurized to the pressure at which switch 520 opens, switch 520 opens and the pump 522 is turned off. If there is any subsequent decrease of sufficient magnitude in the pressure in load 544, such as by leakage of fluid from the load, switch 520 again closes and pump 522 begins to pressurize conduit 534 to the set pressure.

If the pressure in load 544 should rise above the set pressure of switch 526, such as by a patient shifting more of his or her weight onto the load 544, switch 526 closes, energizing solenoid valve 528 and venting fluid pressure from load 544 through inlet 536 to outlet 550 and thus to atmosphere.

Figure 6:
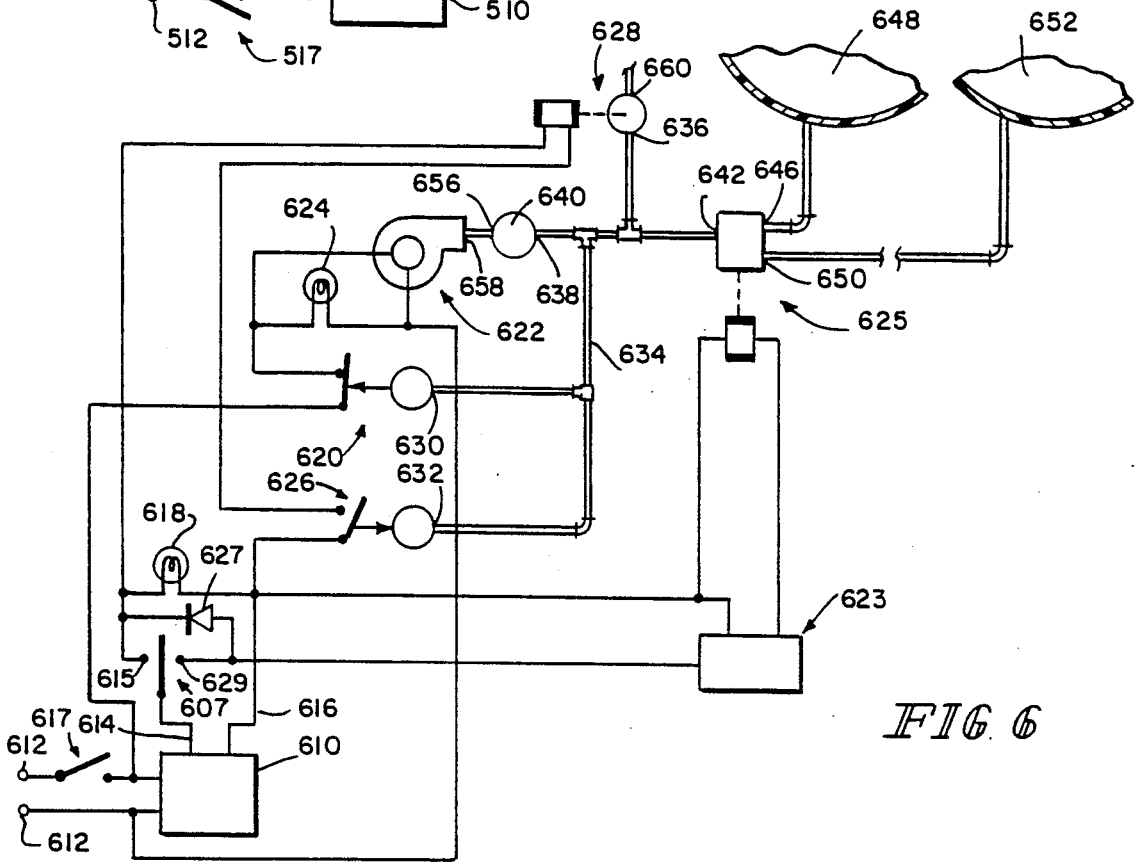

Referring now to FIG. 6, a 115 VAC-to-12 VDC converter 610 and a main power switch 617 are coupled in series across a 115 VAC line 612. 12 VDC is maintained across conductors 614, 616 of converter 610. A 12 VDC power indicator incandescent lamp 618 and one stationary contact 615 of a single pole-double throw switch 607 are coupled in series between conductors 614, 616. A first pressure actuated, normally closed electrical switch 620 and an air pump 622 are coupled in series across 115 VAC line 612 on the converter 610 side of switch 617. A "pump on" indicator incandescent lamp 624 is coupled in parallel with pump 622. A series combination of a second pressure actuated, normally open electrical switch 626 and a normally closed solenoid valve 628 is coupled across lamp 618. A series combination of the other stationary contact 629 of switch 607, a timer 623 and a four-way solenoid valve 625 is coupled to conductor 616. The anode of a diode 627 is coupled to stationary contact 629. The cathode of diode 627 is coupled to stationary contact 615.

Switch 620 has a control fluid pressure inlet 630. Switch 626 has a control fluid pressure inlet 632. Inlets 630, 632 are coupled through a common sensing conduit 634 to a fluid inlet 636 of valve 628, to the low pressure outlet 638 of a check valve 640, and to the inlet 642 of valve 625. One outlet 646 of valve 625 is coupled to a load 648, which illustratively is a first waffle mattress. The other outlet 650 of valve 625 is coupled to a load 652, which illustratively is a second waffle mattress. The high pressure inlet 656 of check valve 640 is coupled to the outlet 658 of pump 622. The outlet 660 of valve 628 is vented to atmosphere.

In operation, when switch 617 is closed, and switch 607 couples conductor 614 to stationary contact 629, and timer 623 places four-way solenoid valve 625 in its position coupling its inlet 642 to its outlet 646, pressure is maintained in load 648 in the same manner as in the embodiment of FIG. 5. That is, once switches 617, 607 are placed in these positions, if the fluid pressure in conduit 634 is below the pressure at which switch 620 opens, switch 620 is closed, placing pump 622 across the line. Pump 622 runs, pressurizing the load 648. The pressure at which switch 620 opens is adjustable. That pressure will be less than the pressure at which switch 626 closes which will also typically be adjustable. Once conduit 634 is pressurized to the pressure at which switch 620 opens, switch 620 opens and the pump 622 is turned off. If there is any subsequent decrease of sufficient magnitude in the pressure in load 648, switch 620 again closes and pump 622 begins to pressurize conduit 634 to the set pressure.

If the pressure in load 648 should rise above the set pressure of switch 626, switch 626 closes, energizing solenoid valve 628 and venting fluid pressure from load 648 through inlet 636 to outlet 660 and thus to atmosphere.

When switches 617, 607 are in these positions and timer 623 places valve 625 in its position coupling its inlet 642 to its outlet 650, pressure is maintained in load 652 in the same manner as previously described with respect to load 648.

When switch 607 couples conductor 614 to stationary contact 615, the timer 623 and valve 625 are removed from the circuit by the now reverse-biased diode 627, and the system functions as described in connection with FIG. 5.

What is claimed is:

1. In combination, a first switch for operation at a first fluid pressure, the first switch having a fluid inlet, a second for operation at a second fluid pressure higher than the first, the difference between the first and second fluid pressure defining a pressure zone within which the combination does not control pressure the second switch having a fluid inlet, a source of fluid pressure, the fluid pressure source having an outlet, an electrically actuated fluid valve, the valve having a fluid inlet and a fluid outlet, means for coupling the first switch across a source of electrical power for controlling the supply of fluid under pressure from the fluid pressure source, means for coupling the second switch across the source of electrical power for controlling the fluid valve, and means for coupling the outlet of the fluid pressure source to the first switch, the second switch and the electrically actuated fluid valve.

2. The apparatus of claim 1 wherein the first switch is a normally closed switch.

3. The apparatus of claim 1 wherein the second switch is a normally open switch.

4. The apparatus of claim 1 wherein the valve is a solenoid valve.

5. The apparatus of claim 1 wherein the means for coupling the outlet of the fluid pressure source to the first switch, the second switch and the fluid valve comprises a check valve, the check valve coupled between the outlet of the fluid pressure source and the inlet of the first switch, between the outlet of the fluid pressure source and the inlet of the second switch, and between the outlet of the fluid pressure source and the inlet of the fluid valve.

6. The apparatus of claim 1 and further comprising a steering valve having an inlet and two outlets, a timer, and means for coupling the steering valve to the timer to be controlled thereby.

7. The apparatus of claim 1 and further comprising a load, the fluid pressure within which is to be controlled, and means for coupling the outlet of the fluid pressure source to the load.

8. The apparatus of claim 7 wherein the means for coupling the outlet of the fluid pressure source to the first switch, the second switch, the fluid valve and the load comprises a check valve, the check valve coupled between the outlet of the fluid pressure source and the inlet of the first switch, between the outlet of the fluid pressure source and the inlet of the second switch, between the outlet of the fluid pressure source and the inlet of the fluid valve, and between the outlet of the fluid pressure source and the load.

9. The apparatus of claim 8 and further comprising a steering valve having an inlet and two outlets, a timer, and means for coupling the steering valve to the timer to be controlled by the timer.

10. The apparatus of claim 9 wherein the load comprises two reservoirs which are alternately to be maintained under fluid pressure and vented, the check valve coupled between the outlet of the fluid pressure source and the inlet of the steering valve, means for coupling one outlet of the steering valve to one of the reservoirs and means for coupling the other outlet of the steering valve to the other of the reservoirs.

11. The apparatus of claim 10 wherein the outlet of the fluid valve is vented to atmosphere.

12. The apparatus of claim 7 wherein the means for coupling the outlet of the fluid pressure source to the first switch, the second switch, the fluid valve and the load comprises a fluid pressure regulator, the regulator coupled between the outlet of the fluid pressure source and the inlet of the first switch, between the outlet of the fluid pressure source and the inlet of the second switch, between the outlet of the fluid pressure source and the inlet of the fluid valve, and between the outlet of the fluid pressure source and the load.

13. The apparatus of claim 12 and further comprising a steering valve having an inlet and two outlets, a timer, and means for coupling the steering valve to the timer to be controlled by the timer.

14. The apparatus of claim 13 wherein the load comprises two reservoirs which are alternately to be maintained under fluid pressure and vented, the regulator coupled between the outlet of the fluid pressure source and the inlet of the steering valve, means for coupling one outlet of the steering valve to one of the reservoirs and means for coupling the other outlet of the steering valve to the other of the reservoirs.

15. The apparatus of claim 14 wherein the outlet of the fluid valve is vented to atmosphere.

16. The apparatus of claim 1 wherein the means for coupling the outlet of the fluid pressure source to the first switch, the second switch and the fluid valve comprises a fluid pressure regulator, the regulator coupled between the outlet of the fluid pressure source and the inlet of the first switch, between the outlet of the fluid pressure source and the inlet of the second switch, and between the outlet of the fluid pressure source and the inlet of the fluid valve.

17. In combination, a load the fluid pressure of which is to be controlled, a first switch for actuation at a first pressure, the first switch having a fluid inlet, a second switch for actuation at a second fluid pressure higher than the first, the difference between the first and second fluid pressures defining a pressure zone within which the fluid pressure in the load is not controlled, the second switch having a fluid inlet, a fluid pressure source having an outlet, an electrically actuated fluid valve having a fluid inlet and a fluid outlet, means for coupling the first switch across a source of electrical power for controlling the supply of fluid under pressure from the fluid pressure source, means for coupling the second switch across the source of electrical power for controlling the fluid valve, and means for coupling the outlet of the fluid pressure source to the first switch, the second switch, the fluid valve and the load.

18. The apparatus of claim 17 wherein the means for coupling the outlet of the fluid pressure source to the first switch, the second switch, the fluid valve and the load comprises a check valve coupled between the outlet of the fluid pressure source and the inlet of the first switch, between the outlet of the fluid pressure source and the inlet of the second switch, between the outlet of the fluid pressure source and the inlet of the fluid valve, and between the outlet of the fluid pressure source and the load.

19. The apparatus of claim 17 and further comprising a steering valve having an inlet and two outlets, a timer, and means for coupling the steering valve to the timer to be controlled by the timer

20. The apparatus of claim 19 wherein the load comprises two reservoirs which are alternately to be maintained under fluid pressure and vented, the check valve coupled between the outlet of the fluid pressure source and the inlet of the steering valve, means for coupling one outlet of the steering valve to one of the reservoirs and means for coupling the other outlet of the steering valve to the other of the reservoirs.

21. The apparatus of claim 20 wherein the outlet of the fluid valve is vented to atmosphere.

22. The apparatus of claim 17 wherein the means for coupling the outlet of the fluid pressure source to the first switch, the second switch, the fluid valve and the load comprises a fluid pressure regulator coupled between the outlet of the fluid pressure source and the inlet of the first switch, between the outlet of the fluid pressure source and the inlet of the second switch, between the outlet of the fluid pressure source and the inlet of the fluid valve, and between the outlet of the fluid pressure source and the load.

23. The apparatus of claim 22 and further comprising a steering valve having an inlet and two outlets, a timer, and means for coupling the steering valve to the timer to be controlled by the timer.

24. The apparatus of claim 23 wherein the load comprises two reservoirs which are alternately to be maintained under fluid pressure and vented, the regulator coupled between the outlet of the fluid pressure source and the inlet of the steering valve, means for coupling one outlet of the steering valve to one of the reservoirs and means for coupling the other outlet of the steering valve to the other of the reservoirs.

25. The apparatus of claim 24 wherein the outlet of the fluid valve is vented to atmosphere.

* * * * *